US006363612B1

(12) United States Patent
Roberts et al.

(10) Patent No.: US 6,363,612 B1
(45) Date of Patent: Apr. 2, 2002

(54) METHOD OF REDUCING BURR FORMATION DURING TURBINE BUCKET COVER MACHINING

(75) Inventors: Dennis William Roberts, Schenectady; David Alan Caruso, Ballston Lake; Joseph Michael Pelech, Rexford; Kiernan Francis Ryan, Niskayuna; John Clifton Williams, Schenectady, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/749,239

(22) Filed: Dec. 27, 2000

(51) Int. Cl.[7] ..... B23P 6/00

(52) U.S. Cl. ..... 29/889.1; 29/402.06; 29/402.09; 29/423; 29/445

(58) Field of Search ..... 29/889.1, 889, 29/889.7, 889.21, 402.01, 402.05, 402.06, 402.09, 402.11, 402.19, 423, 445, 530

(56) References Cited

U.S. PATENT DOCUMENTS 4,155,152 A * 5/1979 Cretella et al.
4,291,448 A * 9/1981 Cretella et al.
4,589,175 A * 5/1986 Arrigoni
5,062,205 A * 11/1991 Fraser
5,238,368 A * 8/1993 Ortolano
5,697,151 A * 12/1997 Werner et al.
6,233,822 B1 * 5/2001 Grossklaus, Jr. et al.

* cited by examiner

*Primary Examiner*—I Cuda Roseh
*Assistant Examiner*—T. Nguyen
(74) *Attorney, Agent, or Firm*—Banner & Witcoff, Ltd.

(57) ABSTRACT

A method of reducing the formation of burrs during machining of turbine bucket covers of a turbine assembly includes the steps of inserting a filler material in a gap formed between adjacent bucket covers of a turbine assembly, machining the bucket covers to produce a desired profile for the bucket covers, and removing the filler material.

20 Claims, 6 Drawing Sheets

METHOD OF REDUCING BURR FORMATION DURING TURBINE BUCKET COVER MACHINING

BACKGROUND OF THE INVENTION

The present invention relates to the machining of turbine bucket covers, and, more particularly, to the reduction of burr formation during the machining of turbine bucket covers.

A turbine assembly is formed by securing a plurality of turbine blades or buckets to a turbine rotor wheel. The buckets have covers formed at their radial ends. The covers are machined to a desired profile to form sealing teeth that line up with similarly configured teeth on spill strips, thereby improving the efficiency of the turbine unit. This machining of the bucket covers introduces burrs into the gaps between adjacent bucket covers. These burrs have been found to cause frequency shifts that may reach as high as 12%. Such frequency shifts can cause excessive vibration during turbine operation, leading to metal fatigue and possibly failure. To remove the burrs, the turbine must be disassembled and the burrs are then ground down. Once the burrs have been removed, the turbine must be reassembled. This process is extremely time consuming, and, consequently, very expensive.

There is a need to provide a method of machining turbine bucket covers that reduces or wholly overcomes some or all of the difficulties inherent in prior known methods. Particular objects and advantages of the invention will be apparent to those skilled in the art, that is, those who are knowledgeable or experienced in this field of technology, in view of the following disclosure of the invention and detailed description of preferred embodiments.

BRIEF SUMMARY OF THE INVENTION

It is, therefore, seen to be desirable to provide a method of machining turbine bucket covers that reduces the formation of burrs during the machining operation, while not requiring the disassembly and reassembly of the turbine in order to do so.

In accordance with a first aspect, a method of reducing the formation of burrs during machining of turbine bucket covers of a turbine assembly includes the steps of inserting a filler material in a gap formed between adjacent bucket covers of a turbine assembly, machining the bucket covers to produce a desired profile for the bucket covers, and removing the filler material.

In accordance with another aspect, a method of reducing the formation of burrs during machining of turbine bucket covers of a turbine assembly includes the steps of providing a plurality of buckets with bucket covers about a rotor wheel, where the buckets extend radially outward from the rotor wheel, each bucket cover has a contact surface to engage in an interfering fit relationship with a contact surface of an adjacent bucket cover and axially extending surfaces on either side of the contact surface, and leading edge and trailing edge gaps are formed between respective axially extending surfaces of adjacent bucket covers; inserting a filler material in each leading edge gap and each trailing edge gap; machining the bucket covers to a desired profile; and removing the filler material.

In accordance with yet another aspect, a method of reducing the formation of burrs during machining of bucket covers of a turbine assembly includes the steps of providing a turbine having a rotor wheel; securing a plurality of buckets about a circumference of the rotor wheel, with each bucket having a cover including an axial contact surface to engage in interfering fit relationship with an axial contact surface of an adjacent bucket cover and axially extending surfaces on either side of the axial contact surface, wherein leading edge and trailing edge gaps are formed between respective axially extending surfaces of adjacent bucket covers; inserting a filler material in each leading edge gap and each trailing edge gap; machining the bucket covers to a desired profile; and removing the filler material.

From the foregoing disclosure, it will be readily apparent to those skilled in the art that the present invention provides a significant advance. Preferred embodiments of the method of the present invention can provide significant reduction in the formation of burrs during machining of turbine bucket covers, thereby saving numerous hours that would otherwise be required to disassemble the buckets and manually remove the burrs. This presents a significant cost savings in the assembly of turbines. These and additional features and advantages of the invention disclosed here will be further understood from the following detailed disclosure of preferred embodiments.

Figure 1:
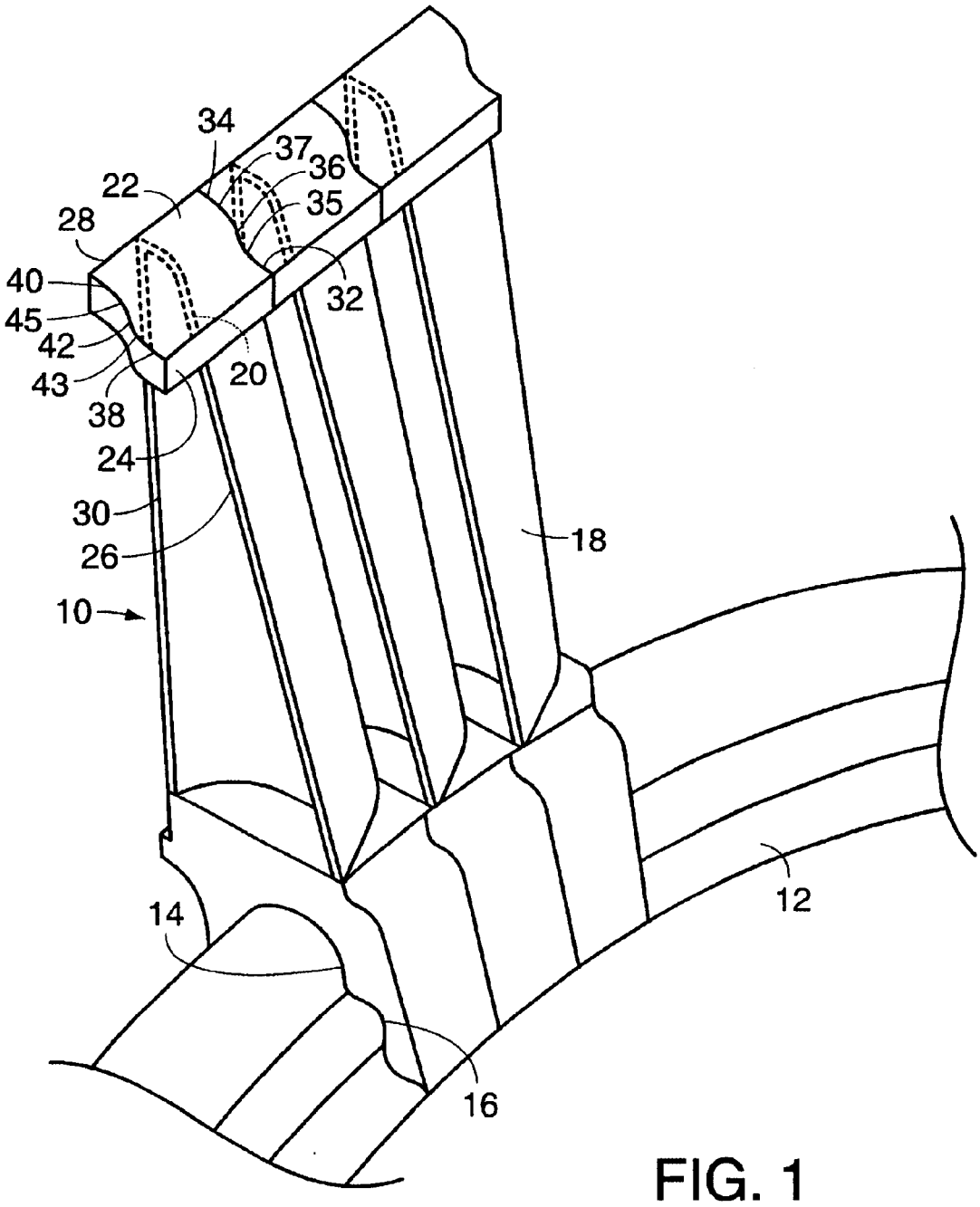
FIG. 1 is a perspective view, shown partially broken away, of a turbine rotor wheel with buckets mounted thereon in accordance with the present invention.

The figures referred to above are not drawn necessarily to scale and should be understood to present a representation of the invention, illustrative of the principles involved. Some features of the turbine assembly components depicted in the drawings have been enlarged or distorted relative to others to facilitate explanation and understanding. The same reference numbers are used in the drawings for similar or identical components and features shown in various alternative embodiments.

DETAILED DESCRIPTION OF THE INVENTION

With reference to FIG. 1, a plurality of turbine blades or buckets 10 are secured to a turbine rotor wheel 12. In the illustrated embodiment, a dovetail shaped slot 14 is formed in a lower portion of bucket 10 that mates with a dovetail shaped surface formed on the rim of rotor wheel 12. Buckets 10, only three of which are shown here, extend a full 360° about rotor wheel 12. Each of the buckets is of identical construction, with the exception of the last bucket (not shown), commonly referred to as the "notch blade," which generally has a larger interference fit due to its larger tangential width, and two buckets adjacent the notch blade that differ in their dovetail area. Buckets 10 are added to rotor wheel 12 vie a radial filling slot (not shown) formed in the rim of rotor wheel 12 in the usual manner, i.e., by moving a bucket radially into the slot and then sliding the bucket tangentially along the rim. Successive buckets 10 are added until an entire row of buckets are mounted on rotor wheel 12. The "notch blade" is then moved in a radial direction into the fill slot and secured to rotor wheel 12 in a conventional manner. Although the illustrated embodiment shows a tangential entry dovetail, it is to be appreciated that axial entry dovetails are also suitable for securing buckets to a rotor wheel, and that these and other methods of securing buckets to a rotor wheel are all considered within the scope of the invention.

Figure 2:
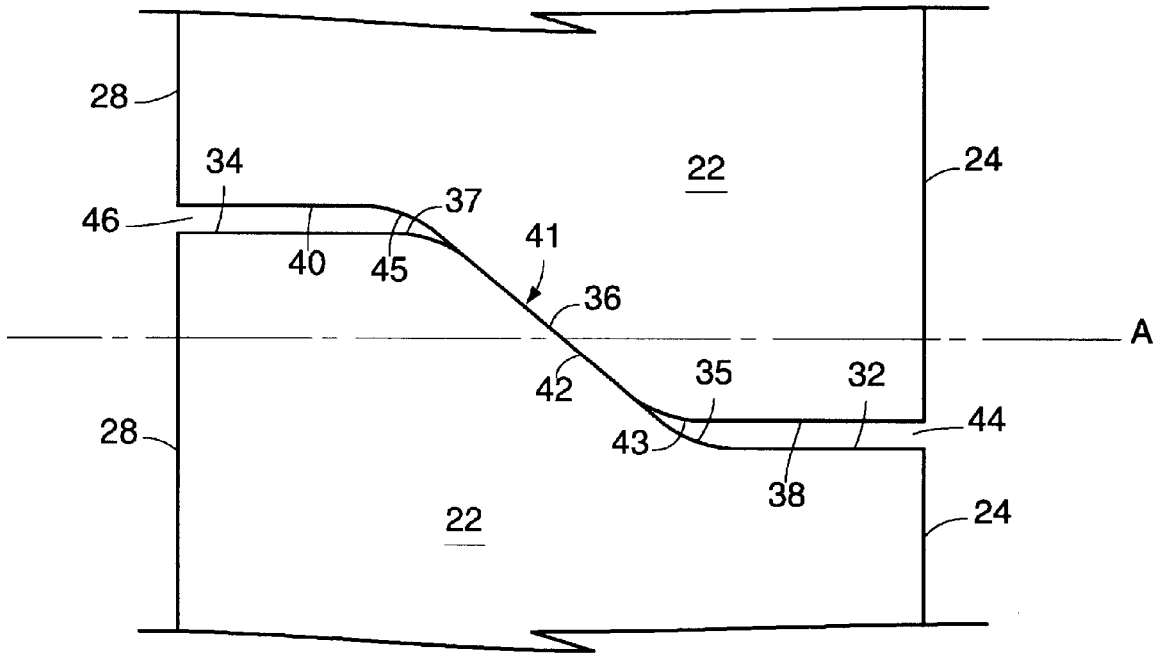
FIG. 2 is a plan view, shown partially broken away, illustrating the manner in which adjacent buckets of FIG. 1 mate with one another.

Blades 18 of buckets 10 extend upwardly in a radial direction from dovetail slot 14 to respective tips 20. Covers 22 are formed on tips 20, and are preferably of unitary, or one-piece, construction with the remainder of bucket 10. Covers 22 couple the entire row of buckets together, 360° about rotor wheel 12. As seen more clearly in FIG. 2, cover 22 has a leading edge 24 adjacent a blade leading edge 26 and a trailing edge 28 adjacent a blade trailing edge 30. One side of cover 22 has a pair of axially extending parallel side edges 32, 34, connected to one another by an angled edge 36, with the intersections 35, 37 of side edges 32, 34 with angled edge 36, respectively, being radiused. The other side of cover 22 similarly has a pair of axially extending parallel side edges 38, 40, connected to one another by an angled edge 42, with the intersections 43, 45 of side edges 38, 40 with angled edge 42, respectively, being radiused. Leading edge 24 is parallel to trailing edge 28, and each of these edges is perpendicular to the axis of rotation of rotor wheel 12, indicated with the letter A, after the machining of covers 22 is complete. Axial side edges 32, 34 are parallel to axial side edges 38, 40, while angled edge 36 is parallel to angled edge 42. It is to be appreciated that directional references used herein, e.g., radial, axial, and tangential, are used in reference to rotor wheel 12 and its axis of rotation A.

The surfaces of angled edges 36, 42 provide steep angle locking, or contact surfaces 41 that introduce pre-twist into buckets 10 as they are slid tangentially along the rim of rotor wheel 12 into tight abutting relationship with adjacent buckets. Along contact surfaces 41 there is an interference fit of between about 5 and about 100 mils, depending upon the particular application. At the interface of side edge 32 and side edge 38 a leading edge gap 44 is formed. Similarly, at the interface of side edge 34 and side edge 40 a trailing edge gap 46 is formed. Leading edge and trailing edge gaps 44, 46 are clearance gaps, typically on the order of 20–25 mils.

Figure 3:
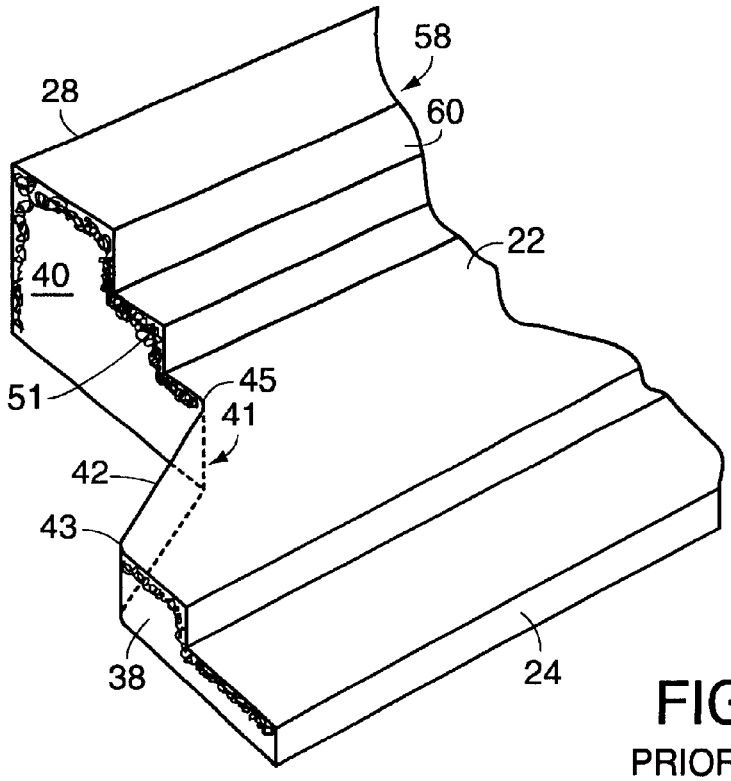
FIG. 3 PRIOR ART
FIG. 3 is a perspective view, shown partially broken way, illustrating the formation of burrs during machining of turbine bucket covers in the prior art.

In the prior art, as depicted in FIG. 3, after all the buckets 10 have been secured to rotor wheel 12, covers 22 are machined to produce a desired profile 58, providing sealing teeth 60 that line up in sealing engagement with similar teeth formed on spill strips (not shown). As discussed above, machining the bucket covers to create the desired profile produces burrs 51 that extend into gaps 44, 46. These burrs 51 must be removed since they can produce a significant frequency shift for the bucket, which can lead to unwanted, and potentially catastrophic, bucket vibrations. Additionally, the burrs that are present in the gaps near contact surface 41 can induce a large restraining moment on the bucket tip. To remove the burrs, the turbine must be disassembled, the burrs are then ground down, and the turbine is then reassembled. This is an extremely time consuming and expensive process.

Figure 4:
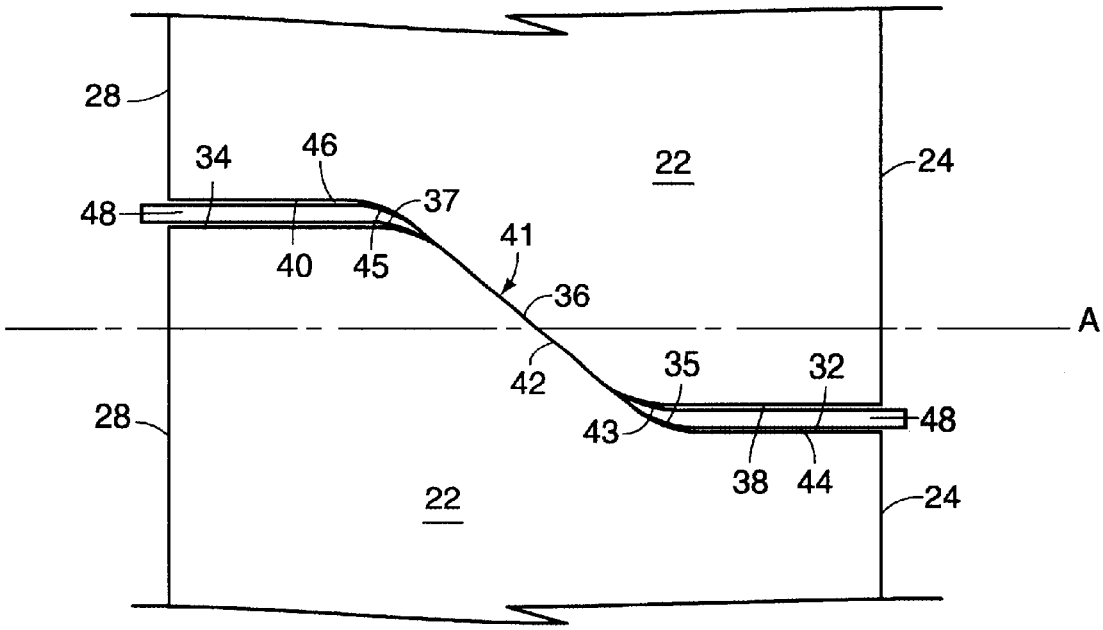
FIG. 4 is a plan view, shown partially broken away, showing the use of shims to fill gaps between adjacent bucket covers in accordance with the present invention.
Figure 5:
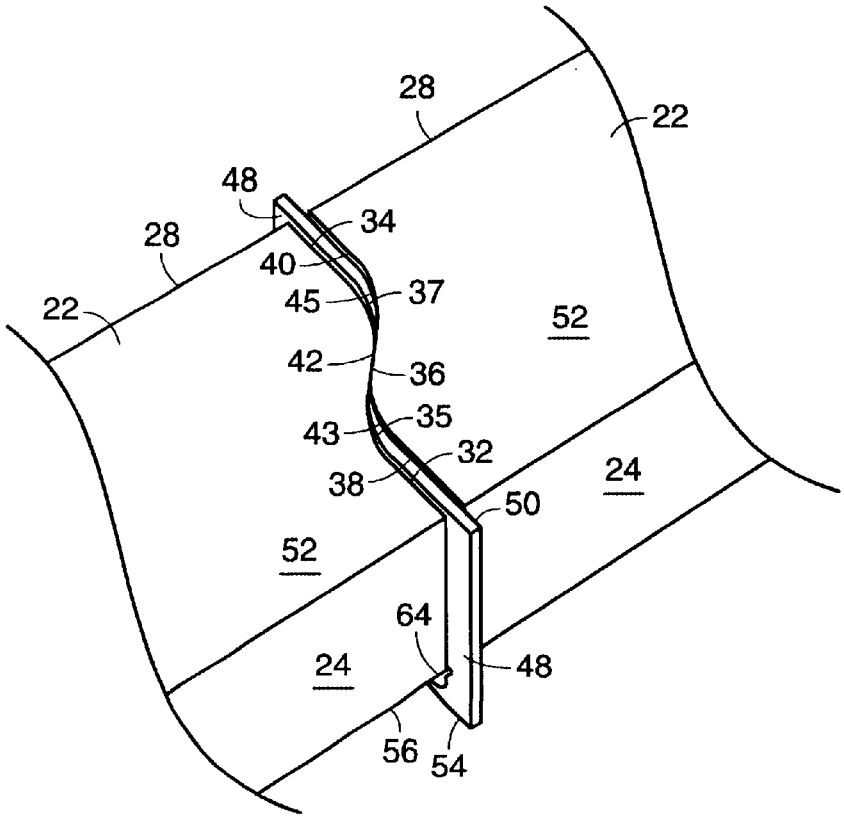
FIG. 5 is a perspective view, shown partially broken away, of the shims of FIG. 4 installed in the gaps between adjacent bucket covers.

As seen in FIGS. 4–5, a preferred embodiment of the present invention includes inserting a filler, such as shims 48, in gaps 44, 46. Shims 48 preferably have a rectangular cross-section, and are of a sufficient width such that they can substantially fill gaps 44, 46. It is to be appreciated that shims 48 may have a tapered cross-section, or have any other suitable cross-section for substantially filling gaps 44, 46. Top edges 50 of shims 48 are preferably aligned in a flush relationship with top surface 52 of cover 22. Lower edges 54 of shims 48 preferably extend below lower surface 56 of cover 22. After shims 48 are inserted in gaps 44, 46, the shims are preferably tapped in an axial direction to make the shims conform to the radiused intersections at the start of the contact surfaces. Due to the tight interference fit between adjacent buckets 10 along contact surface 41, shims 48 extend only into the radiused intersections.

Figure 6:
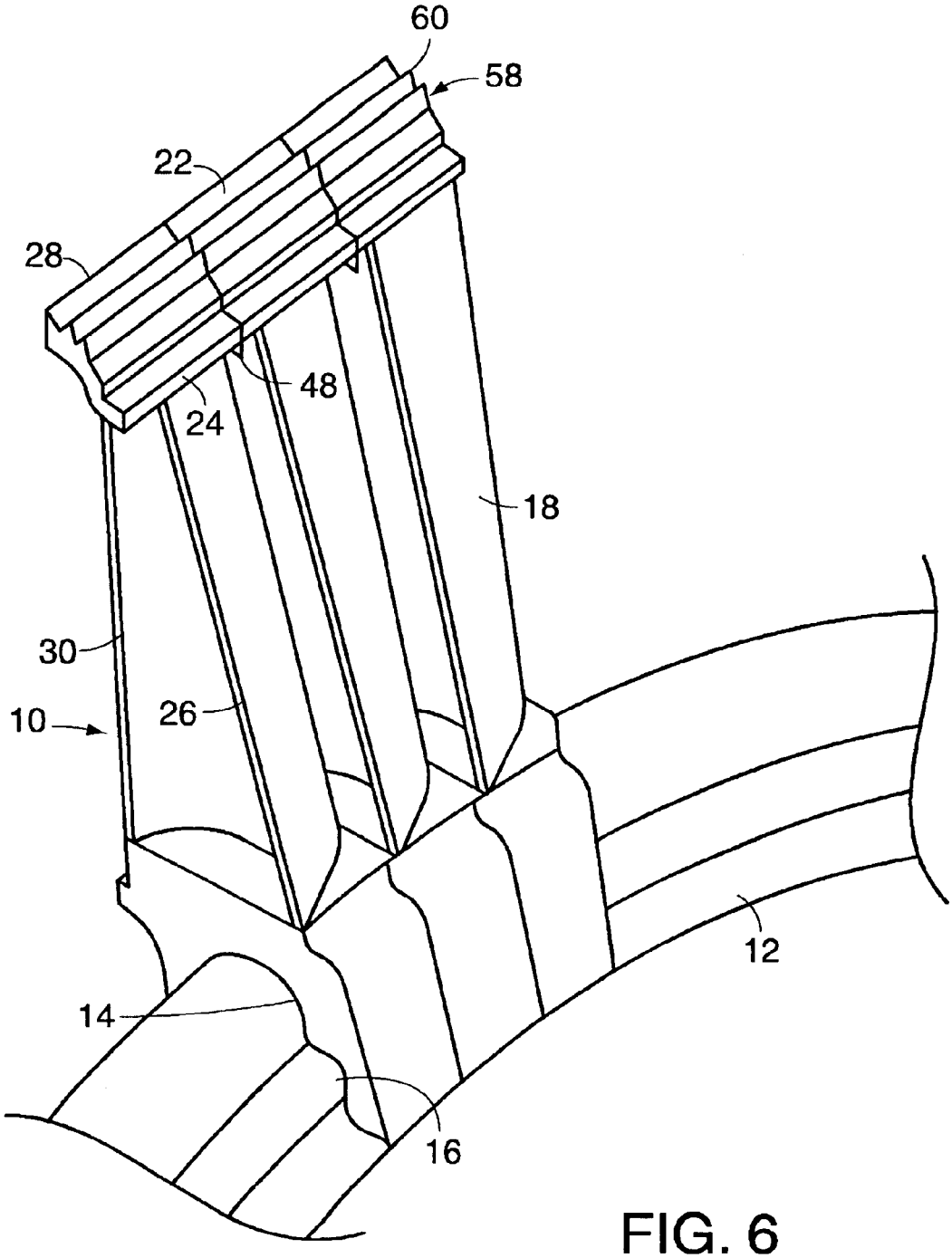
FIG. 6 is a perspective view, shown partially broken away, of the buckets and shims of FIGS. 1 and 4, shown after machining of the bucket covers.
Figure 7:
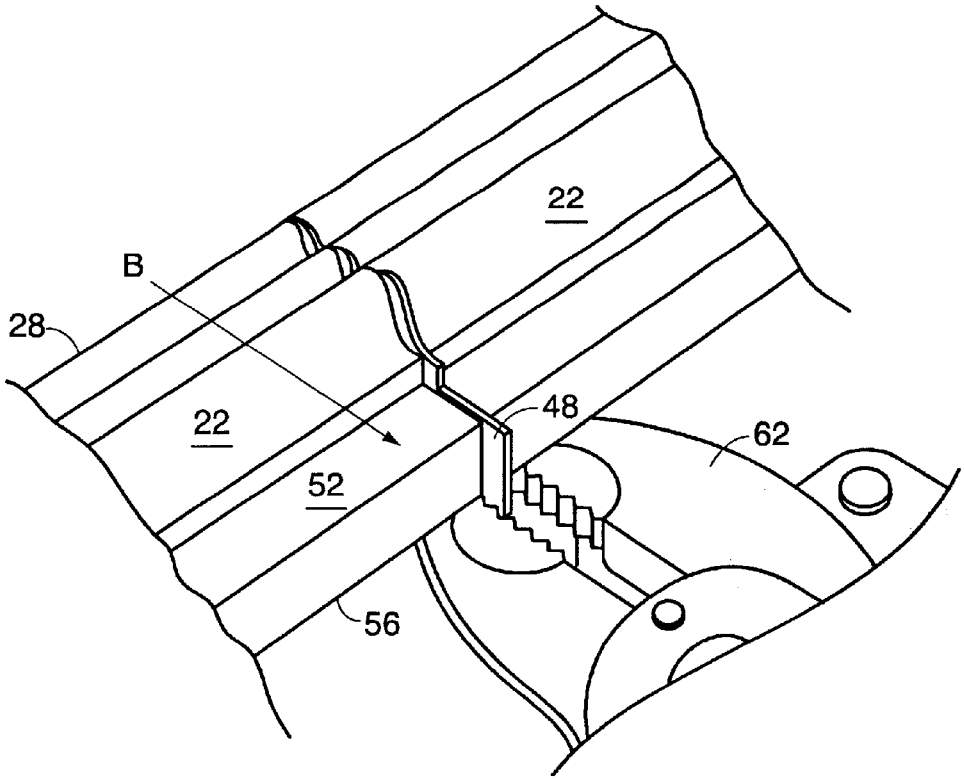
FIG. 7 is a perspective view, shown partially broken away, of the process of removing shims from bucket covers in accordance with one embodiment of the present invention.

As seen in FIG. 6, covers 22 are then machined to a desired profile 58, providing sealing teeth 60 that line up in sealing engagement with similar teeth on spill strips (not shown). During the machining of covers 22, shims 48 reduce the formation of burrs in gaps 44, 46, since the shims fill substantially the entire width of the gaps. Once the machining process is complete, shims 48 are removed from gaps 44, 46, preferably by grasping the portion of shims 48 that extend below covers 22. Shims 48 may be pulled out by hand, or with a tool 62, e.g., pliers, in the direction of arrow B as seen in FIG. 7, where a shim 48 is shown partially removed from covers 22. Through the use of such shims, a significant reduction in the formation of burrs in gaps 44, 46 is realized. In one preferred embodiment, negligible burrs, on the order of 3 mils, were formed when using the shims of the present invention. Such small burrs produce a negligible frequency shift. Thus, the processing of the bucket covers is complete once the shims are removed. Given the method of the present invention, there is no need, as seen in the prior art, to disassemble the turbine to remove burrs after the machining step is complete.

Figure 8:
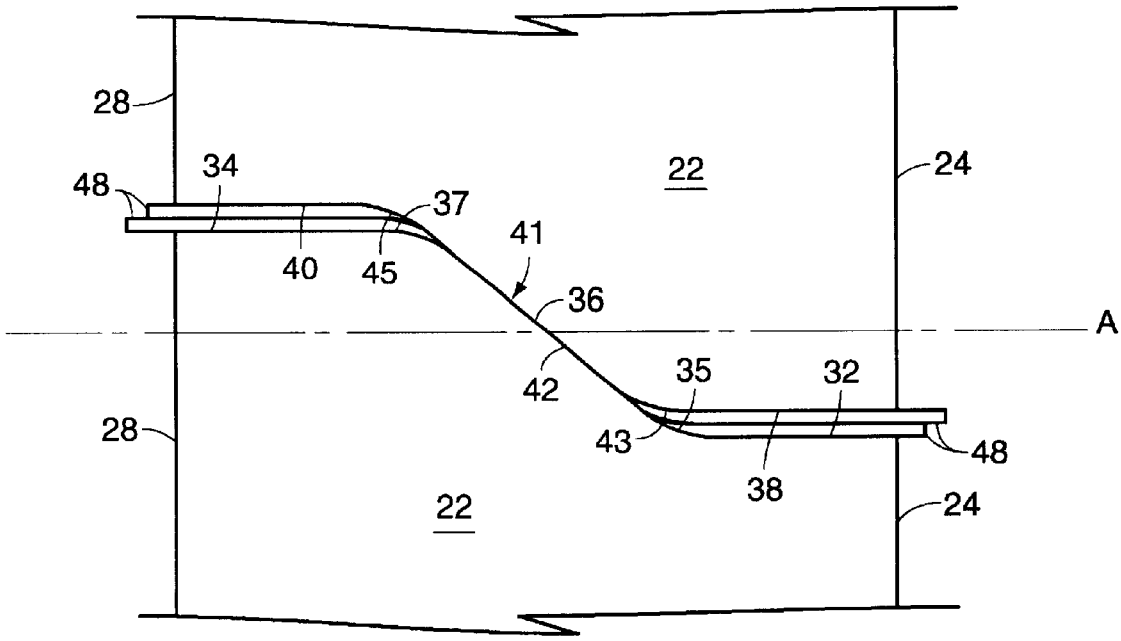
FIG. 8 is a plan view, shown partially broken away, of an alternative embodiment of the present invention, showing the use of a pair of shims in each gap between adjacent bucket covers.

In another preferred embodiment, as seen in FIG. 8, multiple shims 48 may be inserted into each gap 44, 46. For example, inserting two shims 48 in a respective gap provides the shims with increased ability to conform to the radiused intersections, with one shim of the pair of shims being inserted further into the radiused intersection, thereby providing a tighter fit and increased ability to reduce the formation of burrs.

Various materials may be used to form shims 48. For example, metals, e.g., aluminum or copper, or soft materials, e.g., paper-like materials such as Leatheroid™ can be used. In another embodiment, the filler inserted into the gaps may be a liquid hardening material, which hardens, or sets, after being inserted into gaps 44, 46. Exemplary liquid hardening materials include Loctite® and Liquid Nails™.

Figure 9:
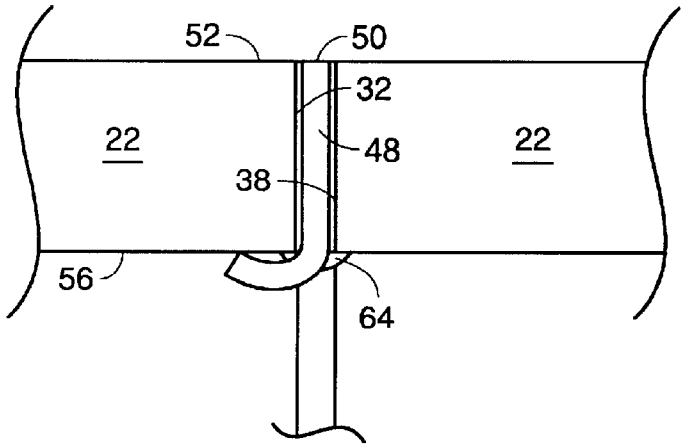
FIG. 9 is an elevation view, shown partially broken away, of another alternative embodiment of the present invention, showing the bending of a shim after it is inserted in a gap between bucket covers.

In certain preferred embodiments, as seen in FIG. 5, shims 48 are secured to covers 22 with adhesive 64 near lower edge 56 of covers 22, to minimize the possibility of shims 48 being drawn upwardly out of gaps 44, 46 as covers 22 are machined to the desired profile. In another embodiment, the portion of shims 48 that extend below lower edge 56 is bent tangentially along lower edge 56, as seen in FIG. 9, to further reduce the possibility of shims 48 being drawn out of gaps 44, 46 as covers 22 are machined.

Figure 10:
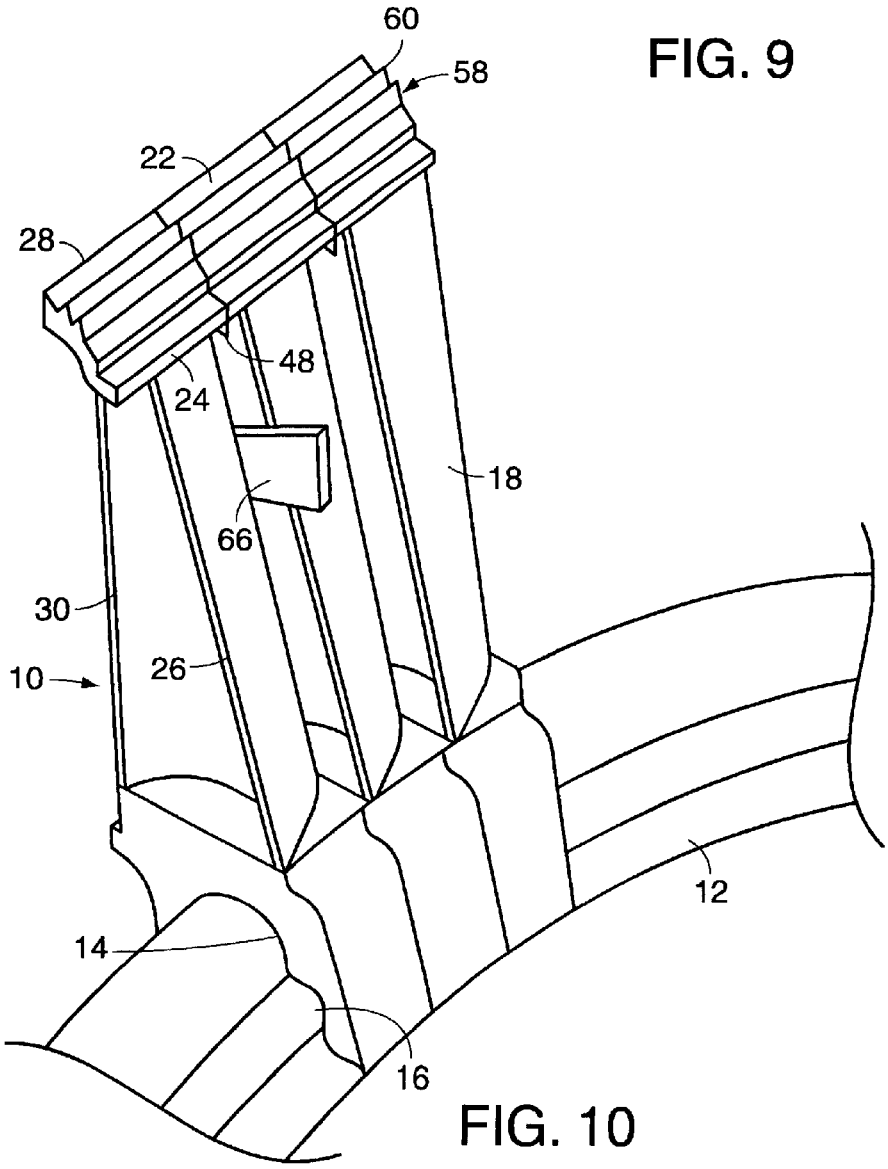
FIG. 10 is a perspective view, shown partially broken away, of another embodiment of the present invention in which a wedge is inserted between adjacent buckets in order to remove shims inserted between adjacent bucket covers.

In other preferred embodiments, as seen in FIG. 10, a lever or wedge 66 may be inserted between adjacent buckets. This will temporarily widen the gaps between adjacent buckets, making the removal of shims 48 from covers 22 easier.

While the present invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of reducing the formation of burrs during machining of turbine bucket covers of a turbine assembly comprising the steps of:

inserting a filler material in a gap formed between adjacent bucket covers of a turbine assembly;

machining the bucket covers to produce a desired profile for the bucket covers; and removing the filler material.

2. The method of claim 1, wherein the filler material is a shim.

3. The method of claim 2, further comprising the step of securing the shim to the bucket covers before performing the step of machining the bucket covers.

4. The method of claim 3, wherein the shim is secured to the bucket covers with adhesive.

5. The method of claim 2, wherein the shim is formed of aluminum.

6. The method of claim 2, further comprising the step of inserting a wedge between adjacent buckets to separate the buckets before removing the shim.

7. The method of claim 2, further comprising the step of inserting at least another shim in the gap between adjacent bucket covers.

8. A method of reducing the formation of burrs during machining of turbine bucket covers of a turbine assembly, comprising the steps of:

providing a plurality of buckets with bucket covers about a rotor wheel, the buckets extending radially from the rotor wheel, each bucket cover having a contact surface to engage in an interfering fit relationship with a contact surface of an adjacent bucket cover and axially extending surfaces on either side of the contact surface, wherein leading edge and trailing edge gaps are formed between respective axially extending surfaces of adjacent bucket covers;

inserting a filler material in each leading edge gap and each trailing edge gap;

machining the bucket covers to a desired profile; and removing the filler material.

9. The method of claim 8, wherein the filler material is a shim.

10. The method of claim 9, further comprising the step of securing the shims to the buckets before machining the bucket covers.

11. The method of claim 10, wherein the shims are secured to the buckets with adhesive.

12. The method of claim 9, wherein the shims are formed of aluminum.

13. The method of claim 9, further comprising the step of inserting a wedge between adjacent buckets to separate the buckets before removing the shims.

14. The method of claim 9, further comprising the step of inserting at least another shim in each leading edge gap and each trailing edge gap before machining the bucket covers.

15. The method of claim 9, wherein the shims extend below a radially inward surface of the bucket covers.

16. The method of claim 15, wherein the shims are bent tangentially below the radially inward surface of the bucket covers.

17. The method of claim 9, further comprising the step of tapping the shims axially toward the contact surfaces before the step of machining the bucket covers.

18. The method of claim 9, further comprising the step of aligning radially outward edges of the shims in flush relationship with radially outward surfaces of the bucket covers before the step of machining the bucket covers.

19. A method of reducing the formation of burrs during machining of bucket covers of a turbine assembly, comprising the steps of:

providing a turbine having a rotor wheel;

securing a plurality of buckets about a circumference of the rotor wheel, each bucket having a cover including an axial contact surface to engage in interfering fit relationship with an axial contact surface of an adjacent bucket cover and axially extending surfaces on either side of the axial contact surface, wherein leading edge and trailing edge gaps are formed between respective axially extending surfaces of adjacent bucket covers;

inserting a filler material in each leading edge gap and each trailing edge gap;

machining the bucket covers to a desired profile; and removing the filler material.

20. The method of claim 19, wherein the filler material is a shim.

* * * * *